US006435481B2

(12) United States Patent
Kahlhamer

(10) Patent No.: US 6,435,481 B2
(45) Date of Patent: Aug. 20, 2002

(54) NEEDLE ADJUSTMENT MEANS

(76) Inventor: Bruce Roland Kahlhamer, Highway 22, P.O. Box 72, Wild Rose, WI (US) 54984

( * ) Notice: Subject to any disclaimer, the term of this patent is extended or adjusted under 35 U.S.C. 154(b) by 0 days.

(21) Appl. No.: 09/864,146

(22) Filed: May 23, 2001

Related U.S. Application Data

(62) Division of application No. 09/394,663, filed on Sep. 12, 1999, now Pat. No. 6,273,403.

(51) Int. Cl.[7] ..... F02M 7/14
(52) U.S. Cl. ..... 261/50.2; 261/66; 261/DIG. 38
(58) Field of Search ..... 261/44.1, 66, 50.2, 261/44.3, DIG. 38

(56) References Cited

U.S. PATENT DOCUMENTS

| | | | | | |
|---|---|---|---|---|---|
| 3,709,469 | A | * | 1/1973 | Edmonston et al. | 261/DIG. 38 |
| 3,965,221 | A | * | 6/1976 | Englert et al. | 261/DIG. 38 |
| 4,008,298 | A | * | 2/1977 | Quantz | 261/DIG. 38 |
| 4,221,747 | A | * | 9/1980 | Edmonston | 261/DIG. 38 |
| 4,349,489 | A | * | 9/1982 | Gaget et al. | 261/DIG. 38 |
| 5,308,554 | A | * | 5/1994 | Edmonston | 261/44.3 |
| 6,273,403 | B1 | * | 8/2001 | Kahlhamer | 261/44.3 |

* cited by examiner

*Primary Examiner*—Richard L. Chiesa
(74) *Attorney, Agent, or Firm*—Loyd W. Bonneville

(57) ABSTRACT

A simplified, easy-to-get-at carburetor interference needle adjustment mechanism to cause a carburetor needle to penetrate the carbureting chamber to a greater or lesser extent to achieve improved carburetion at the level of operation desired.

1 Claim, 4 Drawing Sheets

FIG 5
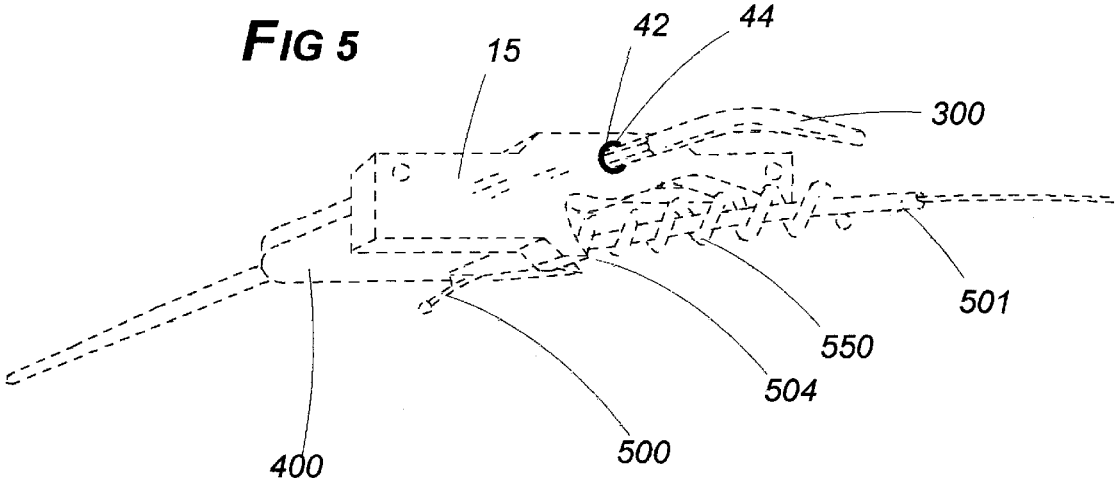
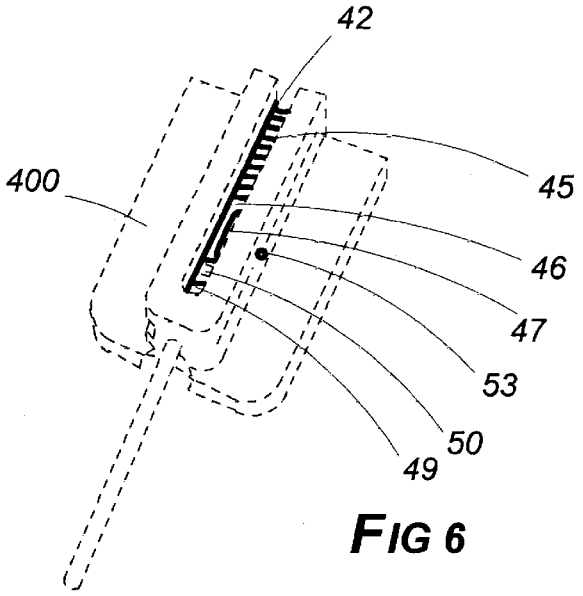
FIG 6

PRIOR ART

NEEDLE ADJUSTMENT MEANS

This instrument was filed under 37 CFR 1.53(b) and 1.78, invoking the provisions of 35 U.S.C. 120 by reason of 35 U.S.C. 121, as a Divisional Application of then application Ser. No. 09/394,663, filed Sep. 12, 1999, upon which U.S. Pat. No. 6,273,403 issued Aug. 14, 2001, entitled "Performance Carburetor".

BACKGROUND OF THE INVENTION

1. Field of the Invention

Combustion engine accessories

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term threaded needle advancement and retraction adjusting tunnel (42) might be used in one instance but in another, if meaning is otherwise clear from context, expression might be shortened to needle adjusting tunnel (42) or merely tunnel (42). Any of those forms is intended to convey the same meaning.

The word comprise may be construed in either of two ways herein. A term used to describe a given object is said to comprise it, thereby characterizing it with equivalency in meaning for the term. Thus, FIGS. 3–6 may be said to comprise views of a carburetion adjusting assembly, meaning that in the particular case, each of the drawings is such a view. However, the word comprise may also be used to describe a feature which is part of the structure or composition of a given element or assembly. Thus, an adjusting tunnel (42) may be said to comprise an external port (44), meaning that the structure of the adjusting tunnel (42) is such as to have the external port (44) as a feature of its (42) structure. The meaning in the respective cases is clear from context, however. Accordingly, modifying words to clarify which of the two uses is the intended one seem unnecessary.

Terms relating to physical orientation such as up, down, higher and lower refer to carburetion assembly positioning in the manner in which it is typically observed in a vehicle and consistent with the manner the subjects of this application are shown in the drawings. Thus, an interference needle stop (50), the positioning of which (50) when present is affected by the adjustment means featured herein, is spoken of as being disposed atop a spacing spring shoulder (51).

Typically, carburetors comprise a sliding mechanism-an airflow obstructor (400)—controlled operationally by retraction or extension of a throttling cable (500). The cable (500) is configured with anchoring means—not specifically addressed herein but part of another divisional—so that when retracted, the airflow obstructor (400) is tugged open to allow therethrough the passage of air. The mixture of air and fuel is ducted to the engine's combustion chambers.

It is generally recognized that carburetors comprise performance characteristics ranging from low level to high level, corresponding with cross-sectional airflow access area causally associated with throttling cable (500) disposition ranging from idling status to full retraction.

Although carburetion has been known since the last century, the never ending search for better efficiency and improved performance continues today.

Despite several historical redesign undertakings and the expectation that performance should increase proportionately to operable throttle advance, carburetion problems remain. It has been observed that the rate of increase levels off or even drops when engine throttling is taken to the higher range. In stressed circumstances such as mountain driving where the air is thinner, the problems become aggravated. Acquiring a larger carburetor to address them unfortunately results in a tradeoff at mid and lower range carburetion levels.

In sports vehicles-snowmobiles and speedboats, for example—carburetor designs providing not only for constancy of efficiency at all carburetion stages but as well for quick acceleration response throughout all levels of operation are constantly sought after. Operational readjustments may be made, of course, to accommodate the problems as they arise during vehicle use. It is not an uncommon experience for an operator to contend with sluggish performance by spending 20 minutes resetting or retuning the carburetor by disassembling and adjusting parts which are virtually inaccessible. The task with snowmobiles is complicated by adverse winter conditions and with boats by buoyant instability upon the water. If attempted with a snowmobile in a remote area, as it sometimes is, the loss of even one of the tiny components can be disastrous.

The needs or objectives pointed out supra thus far remain only partly addressed in the prior art. Some, such as that just immediately addressed, have not been met at all.

SUMMARY OF THE INVENTION

The invention is a distinct carburetor feature providing improved performance, comprising easily accessible needle advancement and retraction adjustment means.

The needle advancement and retraction means (42, 44–49, 53) simplify access to and adjustment of the position of a fuel flow interference needle (900) with reference to the needling fuel jet (800), an otherwise laborious and time consuming task at prior art.

This feature, working in conjunction with others not the subject hereof dramatically enhances engine performance for all engines in general and provides, in particular, excitement for operators of sports vehicles.

BRIEF DESCRIPTION OF THE DRAWINGS

Solid lines in the drawings represent the invention. Dashed lines represent either non-inventive material; that not incorporated into an inventive combination hereof; or that which although so incorporated, lies beyond the focus of attention.

FIGS. 3–6 comprise views of needle advancement and retraction means (42, 44–49, 53 comprising a needle advancement and retraction adjusting tunnel (42) and other elements thereof disposed within an airflow obstructor (400), the drawing also illustrating a prior art fuel flow interference needle (900) comprising a needle stop (50) and needle spacing shoulder (51). Of those four, FIGS. 4 and 5 also illustrate the separateness of the sectors of the throttling cable and its linkage (500, 501, 504, 505, 509, 550) and that of the fine tuning needle adjustment (42, 44).

DESCRIPTION OF THE PREFERRED EMBODIMENT

Figure 1:
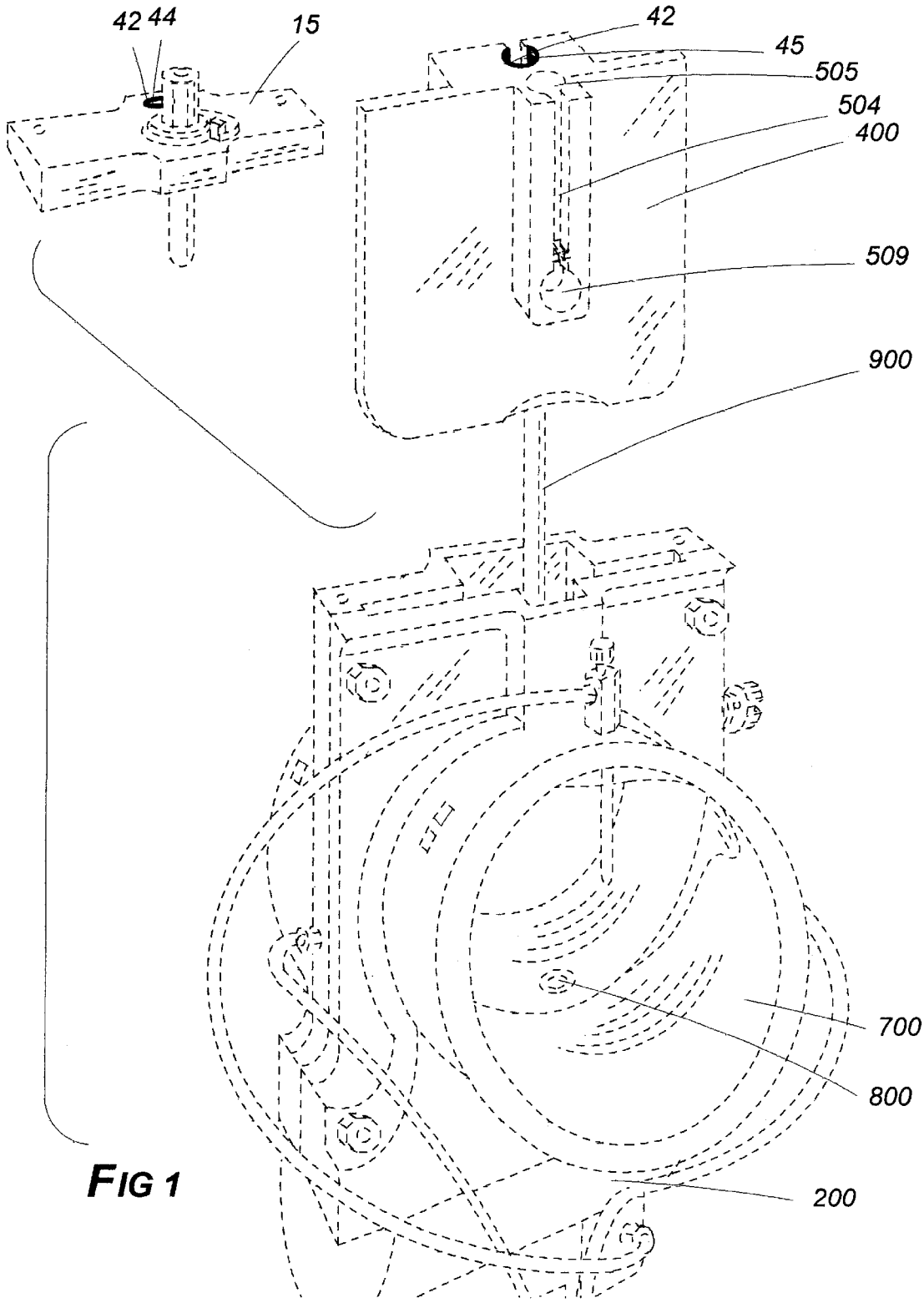
FIG. 1 depicts a perspective exploded view of a carburetor in which certain parts including a carburetor manifold cover (15) and related accessories are separated from the main body.
Figure 2:
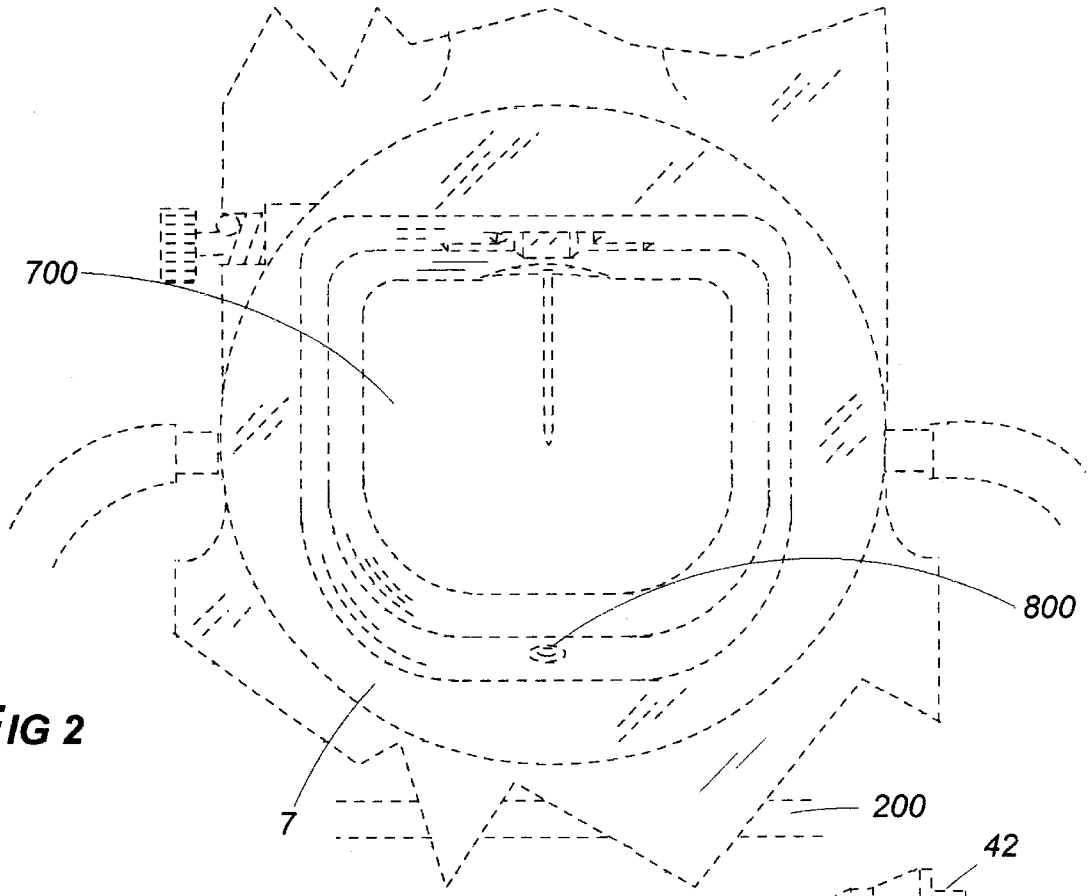
FIG. 2 represents a view of the chamber (700) from its (700) effluxive end (7).

The subject of this application is an innovative carburetor performance feature, which, working in conjunction with others not the subject hereof, achieve startling results.

The invention comprises a carburetion adjusting assembly, several members of which include throttling parts permitting carburetion adjustment merely by hand or foot control during operational use of the vehicle, thereby engaging for the purpose several linkage components. Those parts include a throttling cable (500), a cable sheath (501), a gate spring tunnel (504), an external gate spring tunnel port (505), a cable end trap (509) and a coiled gate spring (550). While they (500, 501, 504, 505, 509, 550) fulfill a role in carburetor control and respond to throttle control in a manner similar to that the subject matter hereof does, they (500, 501, 504, 505, 509, 550) are nonetheless not actually part of the carburetor adjusting assembly addressed herein but are the subject of another divisional. The members of the carburetion adjusting assembly which are the subject hereof include a needle advancement and retraction adjusting tunnel (42), tunnel threads (45), an external tunnel port (44), a threaded adjustment block (46), an adjusting block detent (42), spring loaded block lugs (48) and a set screw for the lug assembly (53). These components of the assembly (42, 44–48, 53) are referred to collectively as an operable adjustment mechanism for needle advancement and retraction and are controlled by operable adjustment means (300). Together with the throttling cable (500) and accompanying linkage (501, 504, 505, 509, 550), they (42, 44–48, 53) control the amount of fuel permitted to enter the carbureting chamber (700) through the needling jet (800), the fuel having been dispensed to the jet (800) from what is well recognized at prior art as the carburetor float assembly (200).

The throttling cable (500) is well known to prior art. Although in an automobile, it is activated by depression of a foot pedal, in sporting vehicles this function is accomplished by squeezing a handgrip lever, rotating a handgrip sleeve or otherwise manipulating a hand operated control. This manual effort retracts the cable (500) and through intermediate mechanical linkage, thereby controls an engine empowering mechanism at its (500) other end which, in a snowmobile and similar vehicle, is the carburetion assembly.

In general, the interference needle (900), well known to prior art, is designed to engage a needling fuel jet (800), the primary component of prior art through which fuel enters the carbureting chamber (700), typically from the bottom thereof (700).

The needle (900) projects in elongation indirectly from linkage with the throttling cable (500) supra and is caused by the cable's (500) movement to protrude into it (800) to a greater or lesser extent. The inventive subject matter hereof is not directed to the means by which the needle (900) is connected to the linkage or other structure, so long as its (900) advancement and retraction occurs in step with that of the throttling cable (500). Moreover, the needle (900) addressed herein is not fettered by limitations in configuration such as bevels or other characteristics which are the subject of a separate divisional. It should be understood that as more of the interference needle (900) penetrates the jet (800), the degree of obstruction becomes such that less of the fuel is permitted to enter the carbureting chamber (700). As at prior art, the degree to which the needle (900) projects into the needling jet (800) is controlled by the extent the cable (500), acting through its (500) accompanying linkage, is retracted or advanced.

Figure 3:
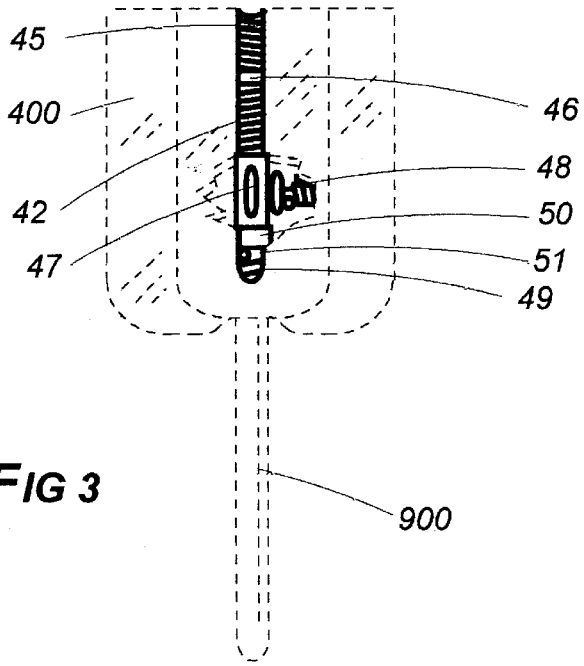
Figure 4:
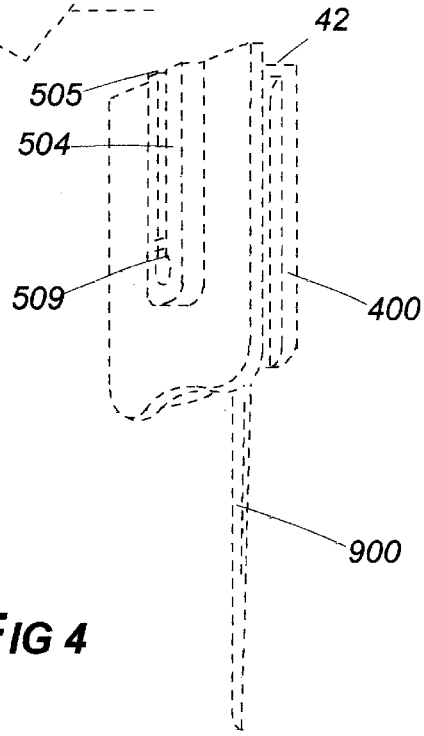
Figure 7:
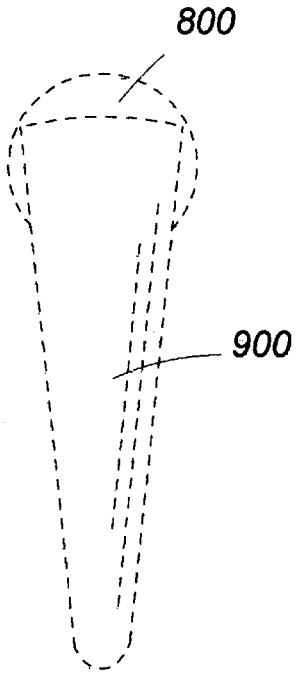
FIG 7 PRIOR ART
FIGS. 7–9 symbolize three penetration states of the interference needle (900) within the needling fuel jet (800).
Figure 8:
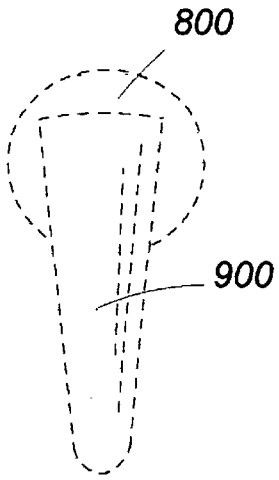
FIG 8 PRIOR ART
Figure 9:
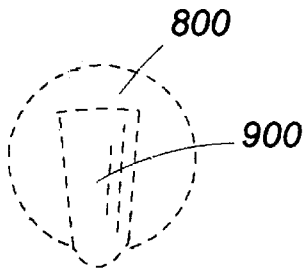

Preferably, the needle (900) comprises a stop (50) and spacing spring shoulder (51) such as shown in FIGS. 3 and 5, which provide suitable means by which the adjusting assembly both retains the needle (900) in place and by reason of interconnection with the assembly, permits adjustments to be made in what might be considered a fine tuning control sense.

The linkage mentioned, supra, comprises means—typically, a spring loaded mechanism of some sort biased in place by the carburetor manifold cover (15)—by which the throttling cable (500) and, therefore, the needle (900) is biased to project so that operator effort is required only to retract the cable (500), not to advance it (500). Many of those means are familiar to prior art and not the subject hereof. Accordingly, the needle (900) is biased to repose most deeply within the jet (800) and is responsive to operator effort only for its (900) withdrawal therefrom (800).

The tunnel (42) comprises a readily accessible external port (44) through which, with the aid of an appropriate but simple tool, operable adjustments regulating the depth of needle (31) protrusion into the needling fuel jet (800) are undertaken. By reason of such configuration, it is unnecessary to disassemble the carburetor to make a performance adjustment as was the case at prior art.

The preferable disposition of the needling fuel jet (800) is the subject of another divisional application.

The threaded needle advancement and retraction adjusting tunnel (42), threaded adjusting block (46) and spring loaded block lugs (48) disposed in the tunnel (42), all of which are referred to supra, accommodate in a fine tuning sense the interference needle's (900) degree of protrusion into the needling fuel jet (800). The tunnel's external port (44), supra, provides access for the adjustment, a feature of paramount importance concerning the invention hereof. The needle itself (900) need only be configured so that it will respond to turns of the threaded adjustment block (46) within the adjusting tunnel (42) while remaining firmly held in place. If present, the stop (50) and spacing spring shoulder (51) mentioned supra would seem particularly useful in that respect. However, numerous structures, configurations and arrangements exist at prior art which retain a needle (900) in such a manner that it (900) will respond directly to turns of the threaded adjusting block (46) to advance and retract it (900). Ideally, the adjusting assembly components could be employed with a needle (900) of any configuration.

Both the stop (50) and spacing spring shoulder (51), if part of the needle's (900) structure, supra, are disposed within the adjusting tunnel (42), the needle stop (50) atop the shoulder (51), which in turn is preferably but not necessarily enwrapped by a needle spacing spring (49).

The threaded adjustment block (46), supra, comprises adjusting block grooved detents (47) disposed therein as shown in FIG. 3. In that embodiment, the detents (47) are configured in the manner of longitudinal grooves.

Operable adjustment means (300) are employed to advance or retract the needle (900) so as to extend more or less of its (900) shank into the needling jet (800). The adjusting block (46) is configured to accommodate turning by a tool comprising a small hexagonal tip emplaced within the tunnel (42) for the purpose. A screwdriver or L-shaped wrench are examples of well recognized operable adjustment means (300).

As adjustment is made, the threads of the adjusting block (46) engage those (45) of the adjusting tunnel (42). As the block (46) turns, the detents (47) disposed therein (46) are engaged by the spring loaded block lugs (48) disposed within the tunnel (42) adjacent to the block (46). Each lug (48) is configured to just fit each detent (47) such that they snap into place with an audible click as the block (46) is turned. Although the fit is snug, sufficient play remains to allow further turning of the threaded block (46). This feature provides a satisfactory adjustment technique since the operator may make an adjustment merely by selecting the number of clicks he or she elects to hear. Each detent (47) is disposed upon the adjustment block (46) circumferentially at fractional turn intervals. Preferably, the number of detents is four, thereby permitting one-quarter turn adjustments at a time.

The block lugs (48), supra,must be retained in place within part of the carburetor structure which advances and retracts in response to the throttling cables's (500) advancement and retraction—a part such as the intermediate linkage referred to supra or, as in the embodiment shown in FIG. 1, an airfow obstructor (400), which is a part of the carburetor which is raised and lowered to control the inflow of air into the chamber (700) and not otherwise itself (400) the subject hereof but of another divisional. It is imprtant to recognize for the purpose hereof, however, that by reason of its connection to the obstructor (400), the interference needle (900) necessarily moves in step with it. As clearly illustrated in FIG. 1, the taper of the needle (900)—as it is typically configured at prior art, further discussed ante—is such as to not only impede to a greater or lesser degree the emission of fuel from the fuel jet (800) but almost equally important and as clearly illustrated in FIG. 1, to expose a greater or lesser obstruction to the airfow as it (400) is raised or lowered. Experience teaches that there is a price to pay by providing any obstruction in the airway, since it invariably affects the Bernoulli or Venturi characteristics of the carbureting chamber (700), addressed supra. Where an obstructor (400) is the housing in which the block lugs (48) are retained, the preferable means of retention is a lug assemble set screw (53), a small fastener disposed upon the obstructor (400) for access by L-shaped wrench (300) or small screwdriver.

As alluded to supra, in normal operation, as the throttling cable (500) is retracted and the airflow obstructor (400) withdrawn from the carbureting chamber (700), the needle (900), connected to the obstructor (400) as it is, is also withdrawn from the needling fuel jet (800) and a larger volume of both air and fuel are, therefore, drawn through the chamber (700) and engine performance increase. At prior art, the interference needle (900) is longitudinally tapered, providing performance level along a gradient. It is well known that a tapered needle (900) confers the smallest diameter thereto (900) at its (900) tip. While this tapering is typically characterized by flatness along the needle's (900) entire extension, a multiply beveled feature not dealt with herein but the subject of another divisional even further diminshes its (900) cross-sectional dimesion disposed across the carbureting chamber (700). As cross-section increases upon the needle's (900) projection into the fuel jet (800) or decreases upon its (900) withdrawal therefrom (800), the obstruction to airfow within the chamber (700) is increased or decreased in a corresponding relationship. For the purposes of this divisional, it is unnecessary to consider the presence or absence of multiple beveling upon the needle (900), however. It is sufficient to recognize the affect upon airflow obstruction merely of the taper itself.

The manifold cover (15) comprises plate-like configuration and is disposed by attachment to overlie the carburetor. Certain means not relevant to this divisional are disposed atop and within the cover (15) to accommodate the linkage for the throttling cable (500). The needle advancement and retraction adjusting means referred to supra are also disposed within and beneath the cover (15), the end of the adjusting tunnel (42) being disposed to exit through it (15).

The inventor hereby claims:

1. An improvement upon a carburetor to which a throttling cable is connected by intermediate linkage and which comprises a tapered fuel flow interference needle disposed for projection into a needling fuel jet such that the throttling cable and linkage advance and withdrawal correspondingly advances and withdraws the needle, exposing greater or lesser needle cross-section across the carbureting chamber, the improvement comprising a needle advancement and retraction threaded adjustment tunnel separately disposed from the throttling cable and linkage, the tunnel in turn comprising:

needle retention means;

a threaded adjusting block disposed within the adjusting tunnel;

an external port disposed atop the carburetor and accessible to operable adjustment means for needle advancement and retraction;

whereby the depth of needle protrusion into the needling jet can be quickly and easily adjusted without removing any parts or otherwise disassembling the carburetor.

* * * * *